US005722716A

United States Patent [19]

Thomas et al.

[11] Patent Number: 5,722,716

[45] Date of Patent: Mar. 3, 1998

[54] CONVERTIBLE FURNITURE FRAME

[76] Inventors: David L. Thomas, 18733 Briarwood Dr., Hagerstown, Md. 21742; Mark D. Thomas, 13302 Clapper Rd., Hagerstown, Md. 21742

[21] Appl. No.: 734,013

[22] Filed: Oct. 18, 1996

Related U.S. Application Data

[63] Continuation-in-part of Ser. No. 454,672, May 31, 1995, abandoned.

[51] Int. Cl.[6] ..... A47C 13/00

[52] U.S. Cl. ..... 297/118; 297/440.24; 297/452.2

[58] Field of Search ..... 297/452.2, 452.63, 297/119, 118, 129, 440.14, 440.24, 463.1, 463.2, 452.4, 107; 5/12.1, 157, 156, 184, 181, 185

[56] References Cited

U.S. PATENT DOCUMENTS

| | | | |
|---|---|---|---|
| 15,943 | 10/1856 | Baum . | |
| 413,730 | 10/1889 | Palmer . | |
| 1,259,022 | 3/1918 | Kean et al. | 5/184 X |
| 1,632,790 | 6/1927 | Fryer . | |
| 1,770,852 | 7/1930 | Hill . | |
| 1,868,642 | 7/1932 | Schlesinger . | |
| 1,945,113 | 1/1934 | Kloboucik . | |
| 2,066,227 | 12/1936 | Reukauf, Jr. et al. . | |
| 2,692,637 | 10/1954 | Rainwater | 297/440.24 X |
| 2,973,525 | 3/1961 | Holtzclaw | 5/181 |
| 3,239,270 | 3/1966 | Milne . | |
| 3,502,357 | 3/1970 | Wagner . | |
| 3,635,522 | 1/1972 | Kerwit . | |
| 3,647,023 | 3/1972 | Bedford, Jr. . | |
| 3,726,055 | 4/1973 | Brant . | |
| 3,726,551 | 4/1973 | Levenberg . | |
| 3,769,638 | 11/1973 | Clanan . | |
| 4,339,123 | 7/1982 | Rich . | |
| 4,456,301 | 6/1984 | Apissomian . | |
| 4,514,106 | 4/1985 | Slager . | |
| 4,583,758 | 4/1986 | Runion et al. . | |
| 4,616,370 | 10/1986 | Keenan et al. . | |
| 4,630,550 | 12/1986 | Weitzman . | |
| 4,643,479 | 2/1987 | Servi . | |
| 4,679,261 | 7/1987 | Stanley et al. . | |
| 4,711,595 | 12/1987 | Magid et al. . | |
| 4,754,506 | 7/1988 | Yeh . | |
| 4,787,319 | 11/1988 | Dupraz . | |
| 4,934,647 | 6/1990 | Edwards . | |
| 5,062,650 | 11/1991 | Chang . | |
| 5,423,592 | 6/1995 | Spurrier et al. . | |
| 5,427,435 | 6/1995 | Yoder, Jr. . | |

FOREIGN PATENT DOCUMENTS

| | | | |
|---|---|---|---|
| 407764 | 4/1942 | Italy | 297/107 |
| 2242116 | 9/1991 | United Kingdom . | |

*Primary Examiner*—Milton Nelson, Jr.
*Attorney, Agent, or Firm*—Nixon & Vanderhye P.C.

[57] ABSTRACT

A furniture frame has components which may be manipulated and/or reoriented so that it assumes various furniture configurations. The furniture frame most preferably includes a number of tubular sections which are joined to one another and separated by at least one cross-support member. A number (e.g., a pair) of detachable leg members having L-shaped sections may be inserted telescopically into the vertical or horizontal tubular components of the side frames and fixed in position, if desired, with the use of conventional pegs, screws, bolts, pins or like fixing elements. Depending upon the relative configuration of these components, therefore, furniture frames for various furniture pieces may be provided using a single frame structure.

22 Claims, 7 Drawing Sheets

CONVERTIBLE FURNITURE FRAME

CROSS-REFERENCE TO RELATED APPLICATION

This application is a continuation-in-part of U.S. patent application Ser. No. 08/454,672 filed on May 31, 1995 (the entire content of which is expressly incorporated hereinto by reference) and now abandoned.

FIELD OF INVENTION

The present invention relates to convertible furniture. In a particularly preferred form, the present invention is embodied in a furniture frame which may be manipulated and/or reoriented so that it assumes various furniture configurations, for example, chair, settee/lounge and bed, as well as desks and tables of various sizes and configurations.

BACKGROUND AND SUMMARY OF THE INVENTION

Furniture which may be converted between various configurations is highly desirable since one piece of furniture may serve several functions. Thus, convertible furniture is, in and of itself, notoriously well known as evidenced from U.S. Pat. Nos. 15,943 to Baum, 1,868,642 to Schlesinger and 3,239,270 to Milne since such furniture is highly desirable to accommodate the needs and/or desires of the user.

While such prior art convertible furniture proposals serve their intended function of providing a single piece of furniture having multiple purposes, some improvement is still needed. For example, it would be highly desirable if a furniture frame could be provided so that any form of furniture may be constructed in dependence upon the users's desires simply by manipulating and/or reoriented one or more components of the frame. It is towards fulfilling such a need that the present invention is directed.

Broadly, the present invention relates to a novel furniture frame having components which may be manipulated and/or reoriented so that it assumes various furniture configurations. In this regard, the furniture frame according to the present invention most preferably includes a number of vertical and horizontal tubular sections which are joined to one another so as to form side frames which are separated latitudinally by at least one horizontally disposed cross-support member. Importantly, a number (e.g., four) detachable L-shaped leg members may be inserted telescopically into the vertical or horizontal tubular components of the side frames and fixed in position, if desired, with the use of conventional pegs, screws, bolts, pins or like fixing elements.

Depending upon the relative configuration of these components, therefore, furniture frames for various furniture pieces may be provided using a single frame structure. For example, two legs may be inserted into the upper horizontal tubular components of the side frames to form supports for a chair back. In a similar manner, two of the legs may be inserted into the bottom horizontal tubular components of the side frames and fixed in either a retracted position close to their respective vertical tubular side frame component or an extended position where they serve as leg supports, for example, for a settee/lounge configuration.

Other attributes and advantages of this invention will become more clear after careful consideration is given to the detailed description of the presently preferred embodiments thereof which follows.

BRIEF DESCRIPTION OF THE DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
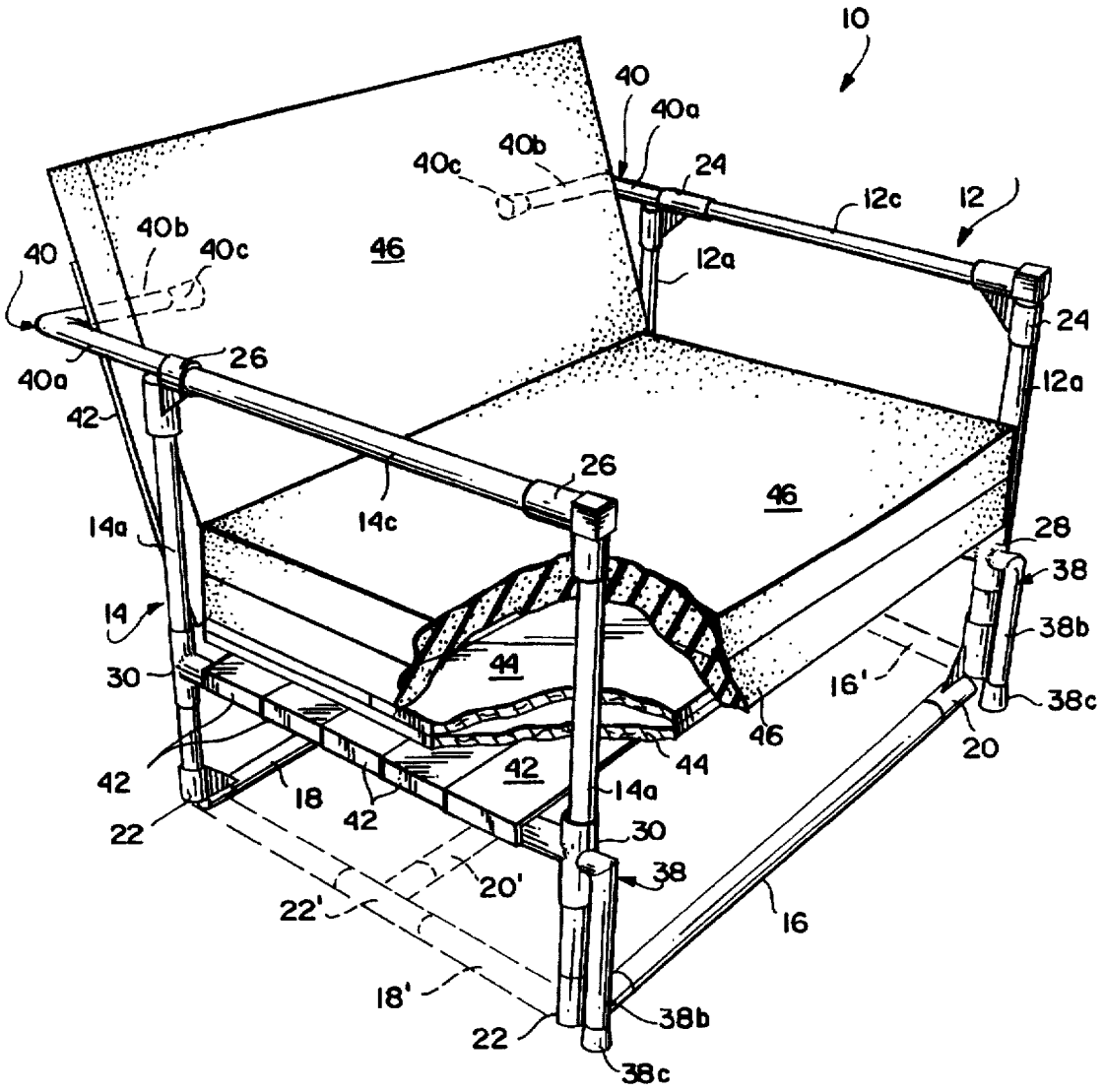
FIG. 1 is a perspective view, partly in section, showing the convertible furniture frame according to this invention in the configuration of a chair/sofa.

The convertible furniture frame 10 according to this invention is shown in accompany FIG. 1 in the configuration of a chair. If desired, the widthwise dimension of the frame 10 can be increased (e.g. by providing cross-support members 16, 18 of increased dimension) so that the frame can be configured in a sofa. For purposes of discussion, however, the frame 10 shown in FIG. 1 will simply be referred to in its chair configuration.

Figure 2:
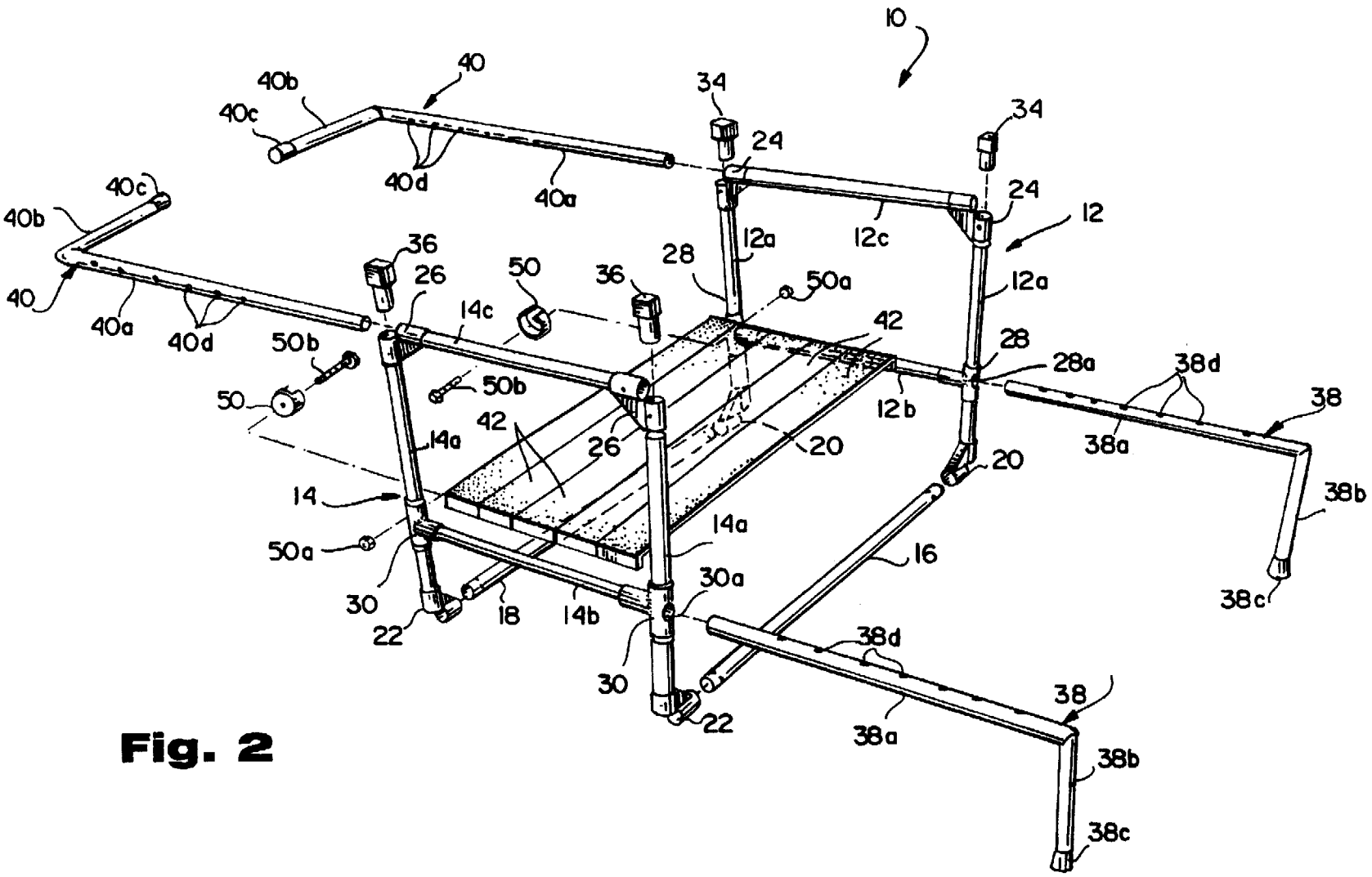
FIG. 2 is an exploded perspective view of the chair/sofa frame configuration shown in FIG. 1 showing the various component structures of the furniture frame of this invention.

The various structural components employed in the chair frame 10 are also shown in the exploded perspective view of FIG. 2 for ease of description and understanding. As shown therein, the frame 10 includes right and left side frames 12, 14, respectively, which are latitudinally separated from one another by a pair of tubular cross-supports 16, 18. In this regard, although a pair of cross-support members 16, 18 are shown in FIGS. 1 and 2, the side frames 12, 14 could likewise be separated from one another using a generally H-shaped bottom frame section comprised of right and left horizontally disposed bottom tubular members 16', 18' and a cross-support member 20' joined thereto by a pair of T-joints 22' as shown in phantom line in FIG. 1 (it being understood, of course, that only one of the T-joints 22' is shown in FIG. 1).

Each end of the tubular cross-supports 16, 18 is inserted into the lower part of an L-shaped joint member 20, 22 provided at the bottom of each of the side frames 12, 14, respectively. The upper part of the L-shaped joint members 20, 22 receives an end of a respective vertical tubular side frame member 12*a*, 14*a*. The upper ends of the vertical tubular side frame members 12*a*, 14*a* are respectively received within the lower part of an upper L-shaped joint member 24, 26 each of which is configured similarly to the lower L-shaped joints 20, 22.

As is seen in FIGS. 1 and 2, pairs of intermediate T-shaped joints 28, 30 are sleeved over the vertical tubular side frame members 12*a*, 14*a* and are vertically spaced above the lower L-shaped joints 20, 22, respectively. A pair of lower horizontal tubular side frame members 12*b*, 14*b* (see FIG. 2) is thus inserted into these intermediate T-shaped joints 28, 30 and form the lower horizontal support for the side frames 12, 14, respectively. Similarly, the ends of a pair of upper horizontal tubular side frame members 12*c*, 14*c* are each inserted into a respective one of the upper L-shaped joints 24, 26 so as to form the upper horizontal support structure for the side frames 12, 14, respectively. The ends of each of the tubular members 12*a*–12*c* and 14*a*–14*c* may be removably secured to their respective joint by means of conventional securing elements not shown, such as pegs, pins, screws, bolt and nut assemblies and the like. The upper L-shaped joints 24, 26 may, if desired, receive decorative corner pegs 34, 36 so as to present a visually and aesthetically smooth transition from the upper tubular side frame members 12*c*, 14*c* to the pairs of vertical side frame members 12*a*, 14*a*.

Pairs of L-shaped leg members 38, 40 are provided each having a relatively longer section 38*a*, 40*a*, and a shorter forward section 38*b*, 40*b*, respectively. The terminal ends of the relatively shorter sections 38*b*, 40*b* may each be covered with an elastomeric cap 38*c*, 40*c*, if desired. As is shown particularly in FIG. 2, the intermediate T-joints 28, 30 are each provided with an opening 28*a*, 30*a* in alignment with the lower horizontal tubular member 12*b*, 14*b*. Thus, each of the relatively longer sections 38*a*, 40*a* of the leg members 38, 40 may be inserted into the opening 28*a*, 30*a* of these T-joints 28, 30 so as to be sleeved within the tubular members 12*a*, 14*a*. It should be noted here that although tubular members 12*a*, 14*a* are shown as a one piece member (which has a bore in alignment with the opening 28*a*, 28*b*), the tubular members 12*a*, 14*a* could also be formed of two pieces (in which case the boring would not be necessary).

Similarly, each of the relatively longer sections 38*a*, 40*a* of the leg members 38, 40 may also be inserted into the upper L-shaped joints 24, 26 so as to be sleeved within either the upper tubular member 12*c*, 14*c* or a respective one of the vertical tubular members 12*a*, 14*a* (i.e., so as to be disposed in either a horizontal or vertical configuration). In any case, telescopic positioning of the leg members 38, 40 may be selected by inserting a pin, screw, bolt or the like thorough longitudinally spaced-apart adjustment holes of the leg members (a representative number of which are identified by reference numerals 38*d*, 40*d* in FIG. 2). In such a manner, the dimensions by which the leg members 38, 40 extend from the side frames 12, 14 may be selected so that the frame 10 may assume various furniture configurations.

It should be understood here that, although accompanying FIG. 2 shows the relatively longer sections 38*a* of the leg members 38 being inserted into the openings 28*a*, 30*a* of the intermediate T-shaped joints 28, 30 on the one hand, while on the other hand the relatively longer sections 40*a* of the leg members 40 being inserted into the upper L-shaped joints 24, 26 so as to project horizontally rearwardly of the frame 10, such a depiction is for the purpose of showing the frame in a configuration suitable to form the chair shown in FIG. 1. Thus, each of the L-shaped legs 38, 40 could be repositioned/reoriented as described above so as to achieve a number of furniture frame configurations, a few of which will be described specifically below with particular reference to FIGS. 3–5.

With the various structural components oriented as described above, the chair as shown in FIG. 1 may be formed using elongate slats 42 to span the horizontal tubular side frame members 12*b*, 14*b* so as to support one or more boards 44 and cushions 46. In such a manner, the seat portion of the chair shown in FIG. 1 may be constructed and supported by the frame 10 according to this invention.

The back portion of the chair may be formed by positioning the relatively shorter sections 40*b* of the leg members 40 horizontally so that each section 40*b* is oriented toward one another. This relative orientation thus allows the leg members 40 to support a board 44 and cushion 46 so as to serve as the back of the chair. The lower edge of the board 44 serving as the chair back is positioned within swivel cup-support members 50 which are respectively pivotally secured to one of the T-joint 28, 30 via nut and bolts 50*a*, 50*b* as shown in FIG. 2. The pivotal mounting of the cup-support members 50 thus allows the leg members 40 to be telescopically extended/retracted relative to the side frames 12, 14 so as to provide for angular adjustment of the chair back.

It will be observed that the chair in FIG. 1 is shown with the leg members 38 fully retracted (i.e., so that the relatively shorter leg sections 38*b* are each closely adjacent to the vertical tubular members 12*a*, 14*a*). However, if desired, these leg members could be telescopically extended to a dimension which accommodates one of the boards 42 and cushions 44 so as to create a settee or lounger type of furniture, in which case the furniture back may be angularly adjusted by the telescopic extension of the other leg members 40 as described above.

Figure 3:
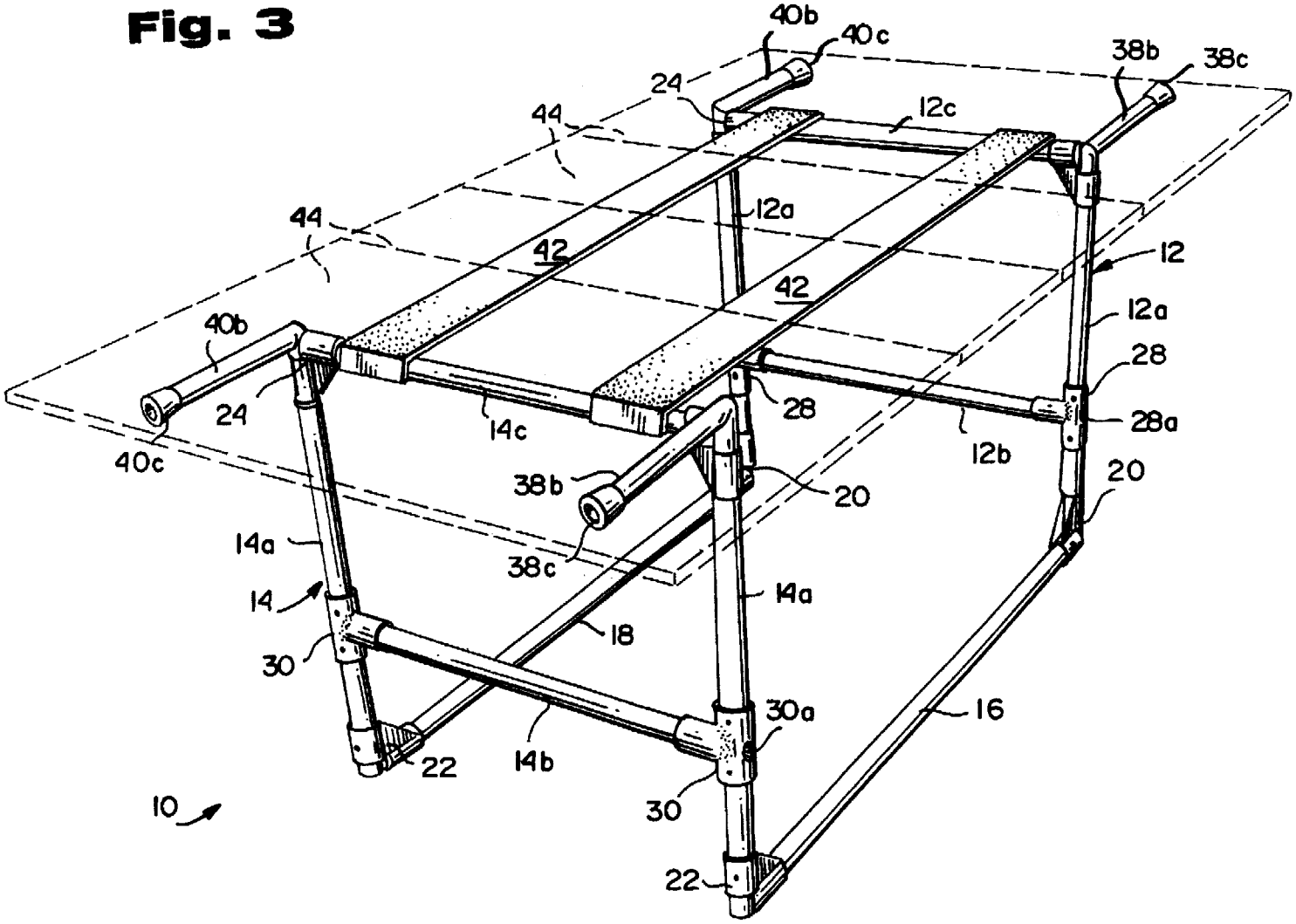
FIG. 3 is a perspective view of the convertible furniture frame of this invention depicted in a table configuration.

The frame components described above with reference to FIGS. 1 and 2 may be repositioned and/or reoriented relative to the side frames 12, 14 so as to achieve a variety of furniture configurations. For example, as shown in FIG. 3, the frame 10 according to this invention may be configured in the form of a table. In this regard, it will be observed that the relatively longer sections 38*a*, 38*b* of the leg members 38, 40 are each telescopically inserted into a respective one of the vertical tubular members 12*a*, 14*a* with the relatively shorter sections 38*b*, 40*b* thereof being horizontally disposed and outwardly oriented parallel to one another so as to support one or more of the boards 44 (which thereby serve as the table top). Further support for the boards 44 may be provided by one or more of the slats 42 spanning the upper tubular side frame members 12*c*, 14*c*.

Figure 4:
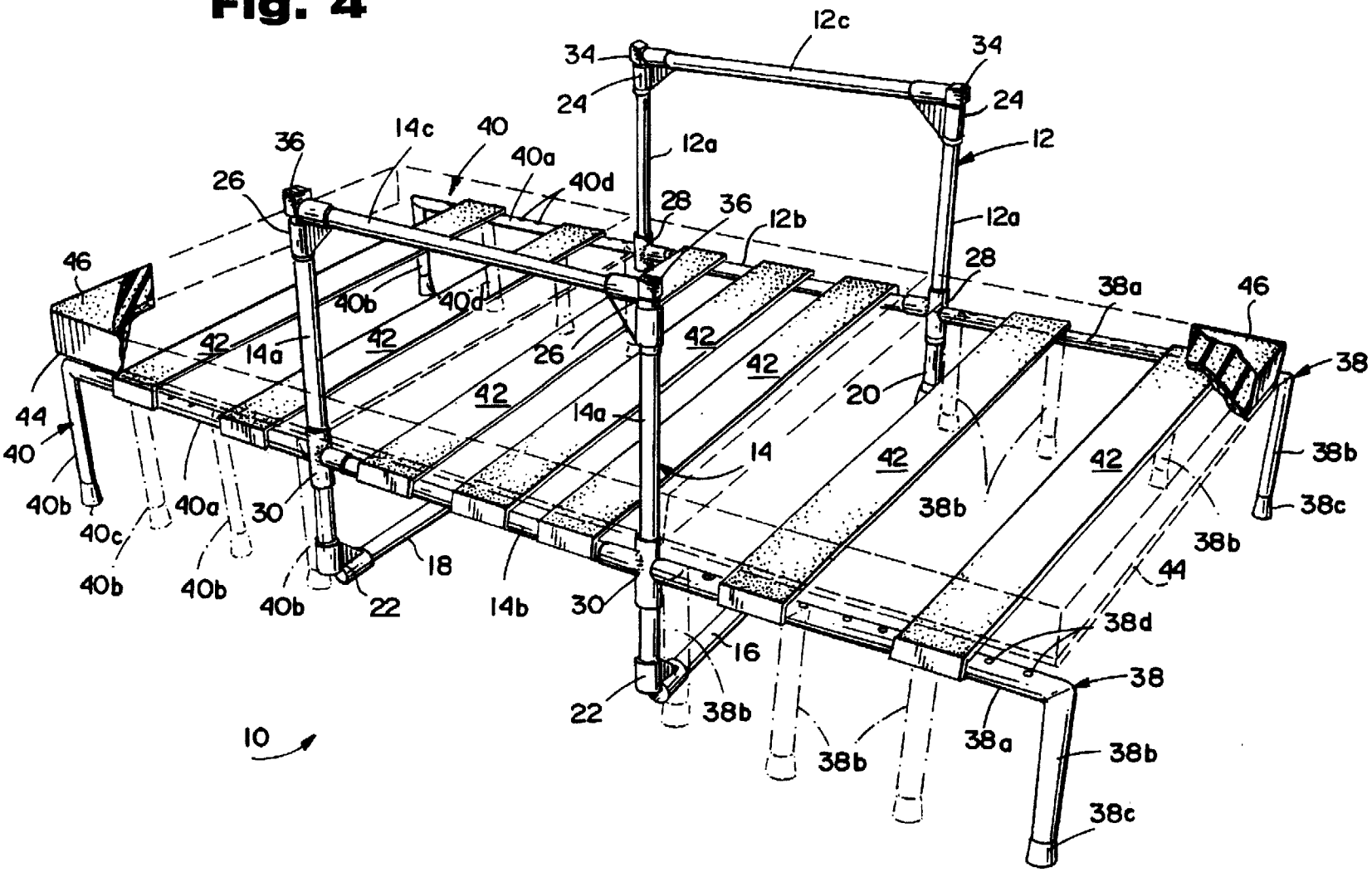
FIG. 4 is a perspective view of the convertible furniture frame of this invention depicted in a bed configuration.

The frame 10 may also be configured in the form of a bed as shown in FIG. 4. In this configuration, it will be observed that each of the relatively longer sections 38*a*, 40*a* of the leg members 38, 40 are each inserted into a respective one of the holes 28*a*, 30*a* of the T-joints 28, 30 with the relatively shorter sections 38*b*, 40*b* being oriented vertically downwardly so that the elastomeric caps 38*c*, 40*c* rest on the floor surface (and thereby support the terminal ends of the leg members 38, 40). A number of slats 42 may thus be provided so as to span the distance between the horizontal tubular side frame members 12*b*, 14*b*, as well as the distance between the relatively longer sections 38*a*, 40*a* of the leg members 38, 40. The slats 42 thus support the boards and cushions 44, 46, respectively, so as to form a comfortable horizontal bed surface. It will also be observed by the phantom line representation in FIG. 4 that the leg members 38, 40 may be extended relative to the side frames 12, 14 as desired, for example, to create a properly sized bed (e.g., a youth or adult bed).

Figure 5:
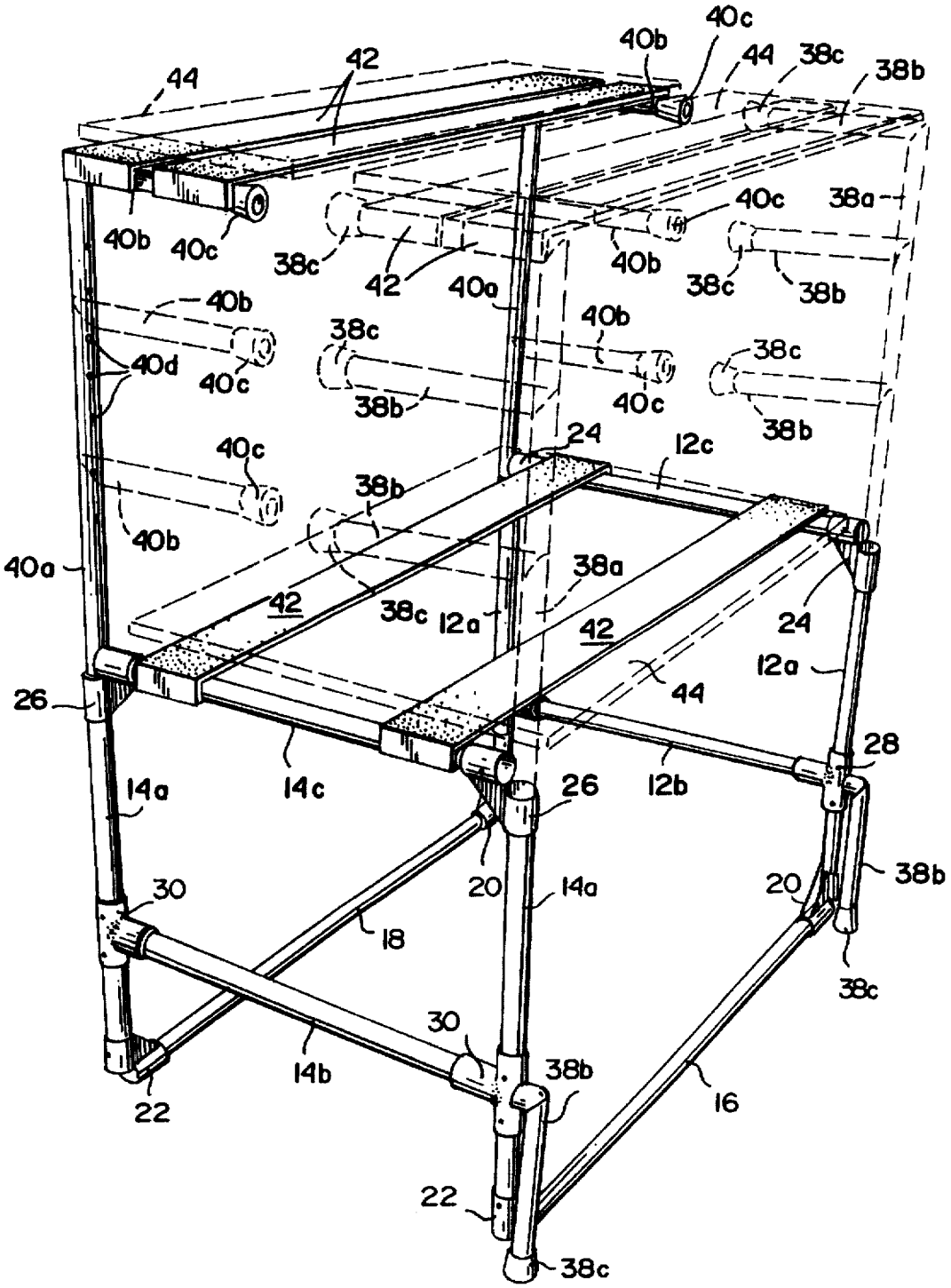
FIG. 5 is a perspective view of the convertible furniture frame of this invention depicted in a desk/bookshelf configuration.

The solid line representation in FIG. 5 shows the frame 10 according to this invention configured in a desk and bookshelf arrangement. In this regard, the desk and bookshelf arrangement shown in FIG. 5 is similar to the table configuration shown in FIG. 3, with the principal exception being that the relatively longer sections of the L-shaped leg members 40 are telescopically inserted vertically into a respective one of the L-joints 24, 26, with the relatively shorter sections 40*b* being forwardly oriented and parallel to the upper tubular side frame members 12*c*, 14*c*. In the arrangement of FIG. 5, therefore, a number of the slats 42 may be supported by and span the distance between both the upper tubular members 12*c*, 14*c* and relatively shorter sections 40*b* to, in turn, support one or more of the boards 42 which thereby serve as the desk top and book shelf, respectively.

If desired, the frame 10 can be configured into a book shelf arrangement by orienting the leg members 38 vertically in a mirror image to the leg members 40 as shown in phantom lines in FIG. 5. In either arrangement, however, height adjustment of the shelf may be selected depending upon the dimension by which the leg members 38 and/or 40 extend above the side frames 12, 14 (i.e., by selective positioning of a pin, screw or bolt into one of the adjustment holes 38*d*, 40*d* as described previously).

Figure 6:
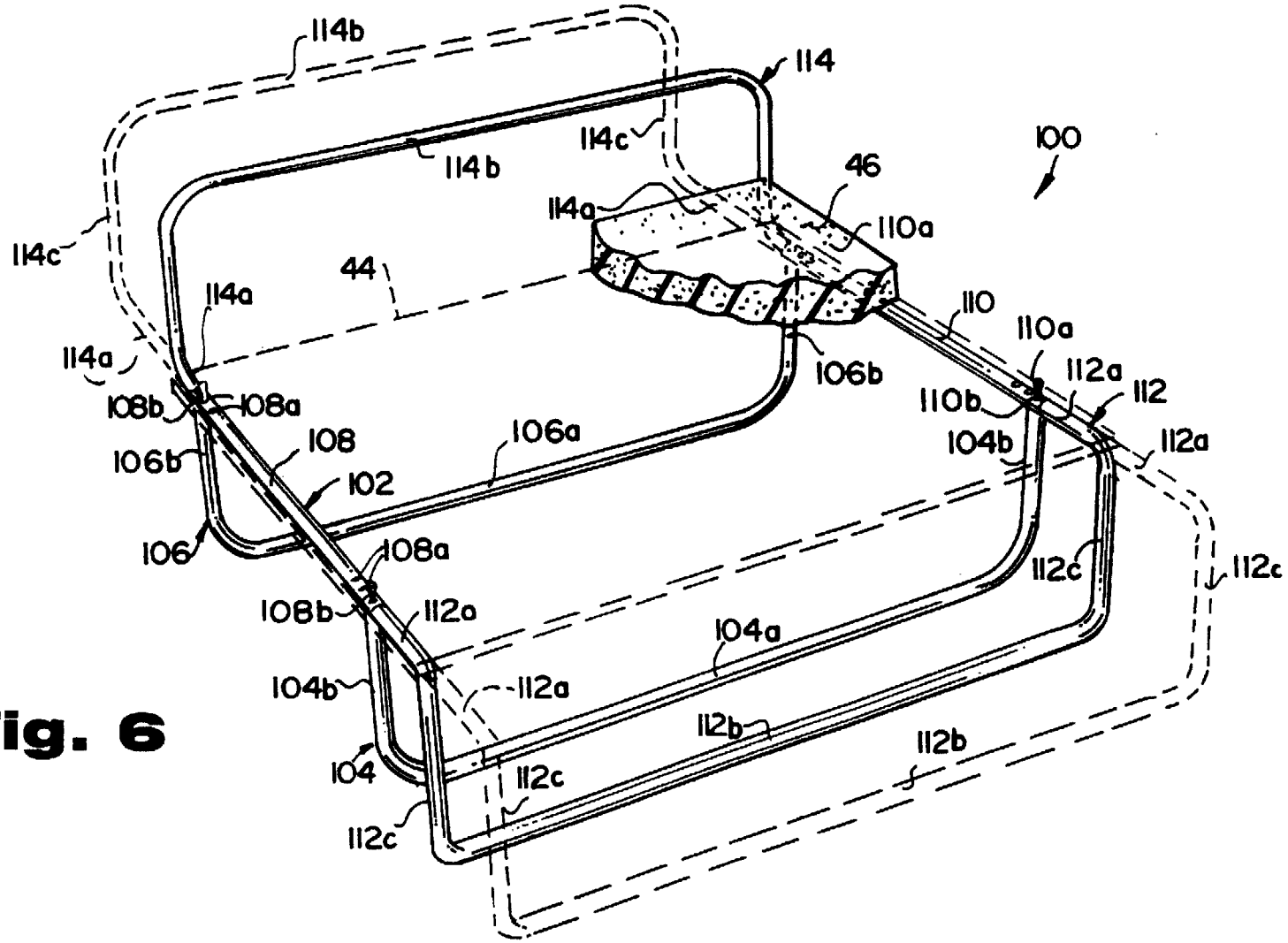
FIG. 6 is a perspective view, partly in section, showing another embodiment of the convertible furniture frame according to this invention in the configuration of a chair/lounge.

Another embodiment of a convertible furniture frame 100 is shown in accompanying FIGS. 6. In this regard, the frame 100 includes a base frame 102 comprised of a pair of generally U-shaped support members 104, 106 which are separated from one another by a pair of tubular cross-support members 108, 110. Specifically, the support members 104, 106 are each most preferably a one-piece structure formed by bending a tubular component to form a relatively longer intermediate section 104*a*, 106*a*, and a pair of relatively shorter terminal end sections 104*b*, 106*b*. Each of the cross-support members 108, 110 is thus rigidly coupled (e.g., via welding) to, and extend between, a respective pair of the terminal end sections 104*b*, 106*b* of the support members 104, 106, respectively.

Each end of the tubular cross-support members 108, 110 is adapted to receive in a telescopic manner the relatively longer leg sections 112*a*, 114*a* of frame leg members 112, 114, respectively. The leg members 112, 114, like the support members 104, 106, are most preferably one-piece structures formed by bending a tubular component to form an intermediate section 112*b* which separates pairs of L-shaped ends comprised of the relatively longer leg sections 112*a*, 114*a* and relatively shorter leg sections 112*c*, 114*c*. As shown in FIG. 6, the relatively longer and shorter leg sections 112*a*, 112*c* and 114*a*, 114*c* of the leg members 112, 114 are generally L-shaped so that planes defined by the relatively longer leg sections 112*a*, 114*a* are generally perpendicular to planes defined by the relatively shorter leg sections 112*c*, 114*c*, respectively.

The cross-support members 108, 110 are provided with a number of apertures 108*a*, 110*a* which register with an aperture(s) (not shown) formed in the longer leg sections 112*a*, 114*a* of leg members 112, 114, respectively. In such a manner, therefore, the leg members 112, 114 may be telescopically extended/retracted as desired relative to the cross-support members 108, 110 (i.e., as shown in phantom line in FIG. 6) and locked in place using conventional pin elements 108*b*, 110*b* so as to achieve a desired configuration of the frame 100. For example, the relatively shorter leg sections 114*c* may be directed upwardly (i.e., in an opposite, but parallel, direction) relative to the members 106*b*, while the relatively shorter leg sections 112*c* may be directed downwardly (i.e., in the same, but parallel direction) relative to the members 104*b*. As in the embodiment of the frame discussed previously, the frame 100 may support one or more boards 44 and cushions 46. Thus, it will be observed in FIG. 6 that the frame 100 is configured in the form of a chair/lounge.

The leg sections 112*a*, 114*a* of leg members 112, 114, respectively, may be positionally locked to the cross-support members 108, 110 using any conventional means. Thus, for example, the cross-support members 108, 110 may be provided with a conventional friction lock mechanism which effects greater/lesser frictional engagement with the leg sections 112*a*, 114*a* in dependence upon the direction of its rotation. Alternatively (or additionally), the leg members could be provided with a spring-loaded detent button which may be depressed to be disengaged with an aperture 108*a*, 110*a* to allow telescopic movement of the leg sections 112*a* and/or 114*a* relative to the cross-support members 108 and 110. Upon registry with another one of the apertures 108*a*, 110*a*, the spring loaded detent button would be urged into engagement therewith to lock the leg members 112, 114 in a new position relative to the cross-support members 108, 110. Suffice it to say here, therefore, that virtually any mechanism which can positionally lock a pair of telescopically sleeved components may be employed as mechanical equivalents to the aperture/pin assemblies depicted in the drawing FIGURES and thus are included within the scope of the present claims.

Figure 7:
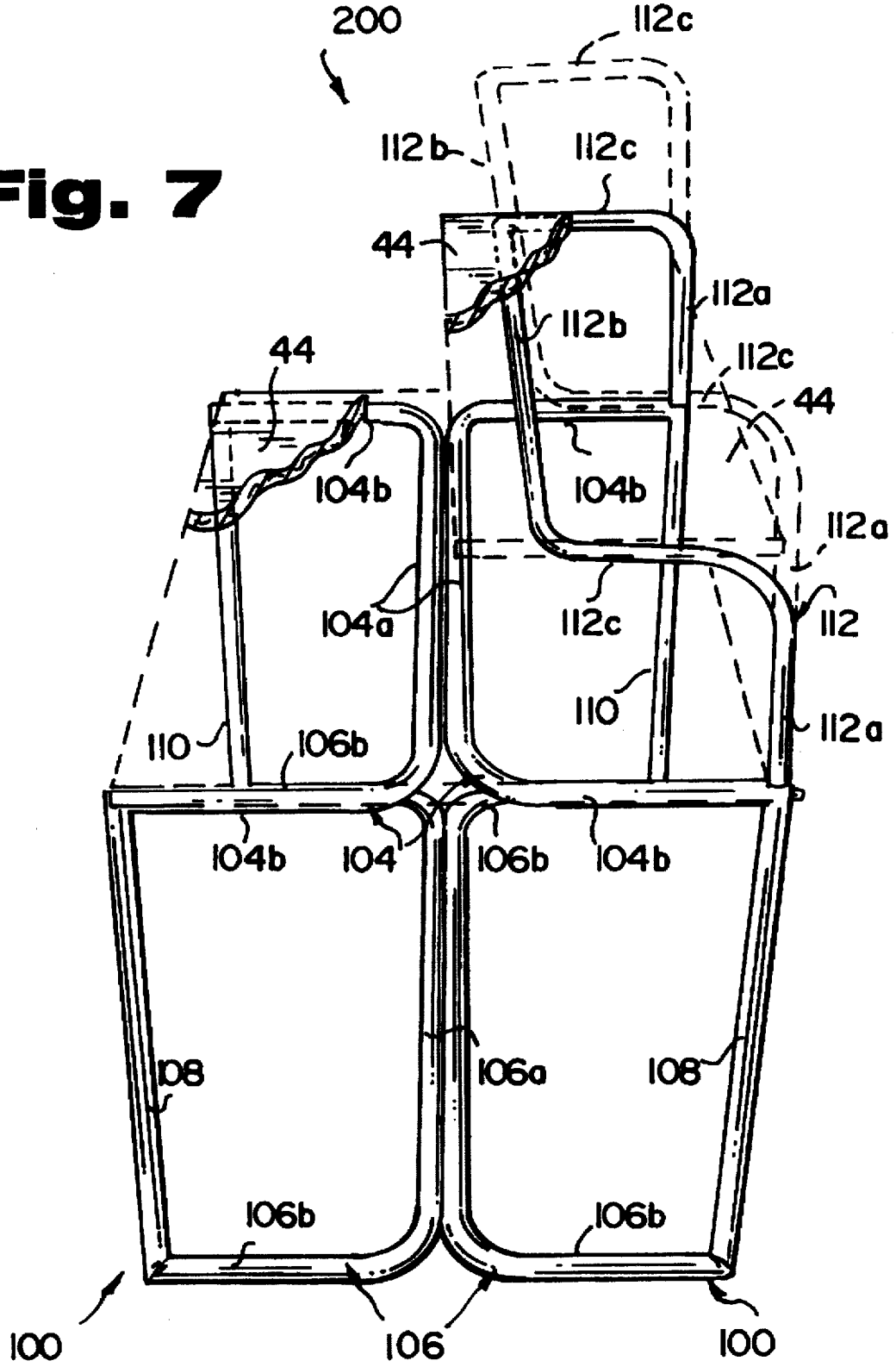
FIG. 7 is a perspective view, partly in section, of the convertible furniture frame embodiment shown in FIG. 6, but depicted in a desk and bookshelf configuration.

The components of the frame 100 discussed above may be arranged to assume other furniture configurations. For example, as shown in FIG. 7, the frame 200 is comprised of a pair of frame members 100 in a "back-to-back" relationship so as to support a board 44 and thereby form the writing surface of a desk. A single leg member 112 is provided with the shorter leg sections 112*a* extending over the desk's writing surface so as to support another board 44*a* thereby forming a bookshelf. The leg member 112 (and hence the bookshelf established thereby) may be telescopically raised/lowered relative to its respective frame 100 as desired.

As can now be appreciated, the frames of the present invention provide a user with a number of furniture configuration options which are believed to not be possible with prior art convertible furniture frames. While only a representative number of possible furniture configurations has been shown in the accompanying drawing FIGURES and described above, those in this art may recognize that the component structures of the frames could be reoriented and/or reconfigured to achieve a number of other furniture configurations.

Therefore, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A convertible furniture frame comprising:

a pair of side frames which include opposed separated pairs of vertical and horizontal tubular members joined to one another;

at least one cross-support member joined to and separating said pair of side flames; and at least one pair of L-shaped leg members each having a first leg section and a second leg section which is shorter than said first leg section; wherein said first leg section of said pair of L-shaped leg members is telescopically inserted into a respective one of said vertical and horizontal tubular members of said side frames such that said first leg section is positioned in one of a vertical and horizontal orientation, with said second leg section thereof being in one of a horizontal and vertical orientation, respectively, thereby to provide a desired furniture configuration.

2. The convertible furniture frame as in claim 1, which includes at least two said pairs of L-shaped leg members each having said first and second leg sections.

3. The convertible furniture frame as in claim 1, wherein said first leg sections of said L-shaped leg members includes spaced-apart adjustment holes to allow for selective dimensional extension of said L-shaped leg members relative to said side frame members.

4. The convertible furniture as in claim 1, wherein said L-shaped leg members include an elastomeric cap covering a terminal end of said second leg section.

5. Convertible furniture comprising a convertible frame as in claim 1, at least one support board supposed on said frame, and at least one cushion member support on said support board.

6. The convertible furniture frame as in claim 1, which includes upper and lower pairs of opposed horizontal tubular side frame members each joined to a respective one of said vertical tubular side frame members.

7. The convertible furniture frame as in claim 6, which includes a number of slats spanning at least one of said opposed pairs of said upper and lower horizontal tubular side frame members.

8. The convertible furniture frame as in claim 1, wherein said side frames include opposed pairs of intermediate T-shaped joints each for receiving a respective one of said vertical tubular side frame members and a respective one of said horizontal tubular side frame members.

9. The convertible furniture frame as in claim 8, wherein said T-shaped joints include an opening aligned with said respective one of said horizontal tubular side frame members so that a respective one of said first leg sections of said L-shaped leg members is telescopically receivable therein.

10. The convertible furniture as in claim 8, which includes at least two said pairs of L-shaped leg members each having first and second leg sections, wherein each of said first leg sections of said L-shaped leg members is received within a respective one of said T-shaped joints such that said L-shaped leg members extend outwardly from said side frames with said second leg sections thereof being oriented vertically downward.

11. The convertible furniture as in claim 10, which includes a number of slats supported by and spanning opposed pairs of said first leg sections of said L-shaped leg members.

12. The convertible furniture as in claim 1, wherein said side frames include opposed pairs of L-shaped joints for receiving ends of respective said vertical tubular side frame members and one of said horizontal tubular side frame members.

13. The convertible furniture as in claim 12, further comprising at least one pair of corner pegs removably received in respective ones of said L-shaped joints.

14. The convertible furniture frame as in claim 12, wherein each of said first leg sections of said pair of L-shaped leg members is received within a respective one of said L-shaped joints such that each of said first leg sections of said L-shaped leg members is telescopically received within a respective one of said vertical tubular side frame members with said second leg sections being oriented horizontally parallel in vertically spaced relationship to respective ones of said horizontal tubular side frame members.

15. The convertible furniture as in claim 12, which includes at least two said pairs of L-shaped leg members each having said first and second leg sections, wherein each of said first leg sections of said L-shaped leg members is received within a respective one of said L-shaped joints such that each of said first leg sections of said L-shaped leg members is telescopically received within a respective one of said vertical tubular side frame members with said second leg sections thereof being oriented horizontally outwardly relative to said side frame members.

16. The convertible furniture frame as in claim 15, which includes a number of slats spanning at least one pair of said horizontal tubular side frame members.

17. A convertible furniture frame comprising:

a base frame which includes an opposed pair of generally U-shaped support members;

a pair of tubular cross-support members each rigidly joined to and separating said pair of support members; and at least one leg member having a first leg section and a second leg section which is shorter than said first leg section; wherein said first leg section of said leg member is telescopically inserted into a respective end of said cross-support members of said base frame such that said second leg section is positioned in one of two possible orientations with respect to said base frame, thereby to provide a desired furniture configuration.

18. The convertible furniture frame as in claim 17 wherein said support members are formed of a one-piece tubular structure which is bent to form a pair of terminal end sections and an intermediate section therebetween.

19. The convertible furniture frame as in claim 17, wherein said leg member is formed of a one-piece tubular structure which is bent to form a pair of said first and second leg sections, and an intermediate section joining said pair of second leg sections.

20. The convertible furniture frame as in claim 17, wherein said cross-support member and said first leg section of said leg member include spaced-apart adjustment holes to allow for selective dimensional extension of said leg members relative to said cross-support member.

21. The convertible furniture frame as in claim 17, which includes at least two said leg members each having said first and second leg sections.

22. The convertible furniture frame as in claim 21, wherein each of said leg members is formed of a one-piece tubular structure which is bent to form a pair of said first and second leg sections, and an intermediate section joining said pair of second leg sections.

* * * * *